US007460825B2

(12) United States Patent
Sawanaka et al.

(10) Patent No.: US 7,460,825 B2
(45) Date of Patent: Dec. 2, 2008

(54) SHEET FEEDING APPARATUS AND SHEET PROCESSING APPARATUS

(75) Inventors: Kei Sawanaka, Susono (JP); Satoshi Sugita, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 205 days.

(21) Appl. No.: 11/061,662

(22) Filed: Feb. 22, 2005

(65) Prior Publication Data

US 2005/0191065 A1 Sep. 1, 2005

(30) Foreign Application Priority Data

Feb. 27, 2004 (JP) ..... 2004-054301

(51) Int. Cl.
*G03G 15/00* (2006.01)

(52) U.S. Cl. ..... 399/371; 400/624; 400/708; 271/111; 271/258.01; 271/259; 271/261

(58) Field of Classification Search ..... 271/110, 271/111, 256, 258.01, 259, 260, 261; 400/624, 400/708; 399/16, 17, 23, 367, 370, 371
See application file for complete search history.

(56) References Cited

U.S. PATENT DOCUMENTS 5,347,350 A * 9/1994 Nakahata et al. ..... 399/23
6,125,305 A 9/2000 Sugita et al. ..... 700/213
6,337,970 B1 1/2002 Okamoto et al. ..... 399/407
6,361,038 B1 * 3/2002 Tada et al. ..... 271/111
6,493,534 B2 12/2002 Sawanaka et al. ..... 399/316
6,647,240 B2 11/2003 Fujii ..... 399/371
7,197,273 B2 * 3/2007 Imai et al. ..... 399/371
2002/0129690 A1 9/2002 Yaginuma et al. ..... 83/628
2005/0013620 A1 1/2005 Sugita et al. ..... 399/13

FOREIGN PATENT DOCUMENTS

CN 1375748 A 10/2002
CN 1583535 A 2/2005
JP 01292368 A * 11/1989
JP 9-188420 7/1997

* cited by examiner

*Primary Examiner*—Ren Yan
(74) *Attorney, Agent, or Firm*—Fitzpatrick, Cella, Harper & Scinto

(57) ABSTRACT

A sheet feeding apparatus includes a sheet placing tray on which a sheet is placed, a feeding member for feeding the sheet placed on the sheet placing tray, a first sheet detection unit for detecting presence of the sheet on the sheet placing tray at a first detection position, and a second sheet detection unit for detecting presence of the sheet on the sheet placing tray at a second detection position disposed on an upstream side of the first detection position in a sheet feeding direction. A control unit controls the feeding member so as not to perform the sheet feeding operation when the first detection unit detects the sheet and the second detection unit does not detect the sheet.

9 Claims, 12 Drawing Sheets

FIG.11

| CODE | FIRST DOCUMENT PRESENCE SENSOR 22 | SECOND DOCUMENT PRESENCE SENSOR 24 | THIRD DOCUMENT PRESENCE SENSOR 26 | CONTROLLER 60 |
|---|---|---|---|---|
| (1) | DETECTED | DETECTED | DETECTED | START SHEET FEEDING OPERATION / RECOGNIZE LARGE SIZE |
| (2) | DETECTED | DETECTED | NOT DETECTED | START SHEET FEEDING OPERATION / RECOGNIZE SMALL SIZE |
| (3) | DETECTED | NOT DETECTED | DETECTED OR NOT DETECTED | PROHIBIT SHEET FEEDING OPERATION / ALARM WITH DISPLAY UNIT |
| (4) | NOT DETECTED | DETECTED | DETECTED | PROHIBIT SHEET FEEDING OPERATION / ALARM WITH DISPLAY UNIT |
| (5) | NOT DETECTED | DETECTED | NOT DETECTED | PROHIBIT SHEET FEEDING OPERATION / ALARM WITH DISPLAY UNIT |
| (6) | NOT DETECTED | NOT DETECTED | DETECTED | PROHIBIT SHEET FEEDING OPERATION / ALARM WITH DISPLAY UNIT |
| (7) | NOT DETECTED | NOT DETECTED | NOT DETECTED | READ IN A BOOK READING MODE |

SHEET FEEDING APPARATUS AND SHEET PROCESSING APPARATUS

BACKGROUND OF THE INVENTION

1. Field of the Invention

The present invention relates to a sheet feeding apparatus for feeding sheets and a sheet processing apparatus for processing sheets.

2. Description of the Related Art

Conventionally, an image reading apparatus is known which reads images on a document in an image forming apparatus such as a digital copying machine or a facsimile apparatus. For reading images, in order to read image information on a document, an automatic document feeding apparatus (ADF: Auto Document Feeder, which may hereafter be referred to as ADF) is known which is a sheet feeding apparatus constructed to feed a document having a form of a sheet automatically to a reading position on a document base platen glass (refer to Japanese Patent Publication Laid-open No. 9-188420).

A conventionally known image reading apparatus is provided with two reading modes, i.e. an ADF reading mode in which the image on a document that is conveyed by the ADF placed above the document base platen glass is read by a stationary optical system and a book reading mode in which a document is set on the document base platen glass and the image on the document is read by moving the optical system.

An ADF has a document presence detection sensor that detects the presence or absence of a document on a document tray. For this reason, when a user places a document on the document tray, the document presence detection sensor detects that the document has been placed on the document tray.

Further, the ADF has a document length detection sensor that detects the length of a document (sheet) placed on the document tray. This document length detection sensor is constituted of a first document length sensor, a first document length sensor, a second document length sensor, and a second document length sensor. The first document length sensors and the second document length sensors are sensors of transmittance type similar to the document presence sensor. For this reason, when a document is placed on a document tray 1, the first document length sensors and the second document length sensors are moved by the load of the document (sheet), thereby shielding the light from the first document length sensors and the second document length sensors.

Here, when the light is shielded from only the first document length sensors, the apparatus interlocks with a width detection mechanism that detects with a width regulating plate to recognize that the document has a small size such as A4, A5, B5, LTR, or EXE. In contrast, when the light is shielded from both of the first document length sensors and the second document length sensors, the apparatus interlocks with the width detection mechanism to recognize that the document has a large size such as A3, B4, LGL, or LDR.

When there are no more documents placed on the document tray, each of the sensor flags placed in the ADF is returned to a predetermined position from the document detection position by an elastic member (not illustrated). Then, when the document presence sensor is brought into a detection-OFF state, the apparatus recognizes that there are no documents on the document tray.

However, in a conventional ADF construction such as described above, a user may commit erroneous placing in placing a document on a feeding tray of the ADF. Also, when the user has committed erroneous placing, the conventional ADF cannot issue a suitable error announcement to the user and, moreover, the ADF may execute an erroneous operation that is not intended by the user.

For example, there are cases in which the user has placed a document on the upstream side of the normal document placement position. This may bring the document presence sensor flag and the document presence sensor into a state in which the document cannot be detected in spite of the fact that the user has placed the document on the document tray. For this reason, the conveying document may not be brought into a permission (OK) state, or an error message stating the absence of the documents may be displayed.

Also, if the user presses a reading start button when the user has placed a document on the upstream side of the normal document placement position, the ADF may erroneously recognize that no documents have been placed on the feeding tray, thereby invoking an erroneous operation in which the ADF starts reading in a book mode for reading a document on a document base platen glass even though nothing is placed on the document base platen glass. At this time, when the feeding of the document is not started and the error message stating the absence of the document is displayed even though the document has been placed on the document tray, the user may consider that the apparatus is out of order without noticing the user's own placement mistake.

In recent years, despite the slow improvement of usability, the apparatus are increasing in their scale, complexity, and multifunctional property, so that an increasing number of users are not used to operation of the apparatus. For this reason, there is a fear that an increasing number of users consider that the apparatus is out of order without noticing their own placement mistake as described above.

In addition, there is a problem in that the apparatus starts to operate even if the document is placed by overriding the width regulating plate. This phenomenon occurs when the user places the document by letting the document override the width regulating plate in placing the document on the document tray. At this time, the front end of the document is pressed in to the normal position though the width of the document is not regulated, so that the document presence sensor flag and the document presence sensor (document presence detection mechanism) detect the presence of the document.

When this occurs, the document is started to be fed even though the document is not correctly placed to override the width regulating plate. When the document is conveyed in this state, the document may greatly meander, slip by receiving an unexpected resistance, or cause decrease in the conveying speed because no regulation has been made in the width direction. When this phenomenon intensely occurs, a jam of the document occurs, thereby raising a problem.

Also, when the placed document is a largely curled document or a document having a crease, there is a fear that a jam of the document may occur because the document cannot be conveyed due to the curl or crease after the document is fed.

SUMMARY OF THE INVENTION

The present invention solves the aforementioned problems of the prior art, and an object thereof is to provide a sheet feeding apparatus capable of feeding sheets in a stable manner with improved operability.

According to the present invention, there is provided A sheet feeding apparatus comprising: a sheet placing tray on which a sheet is placed; a feeding member for feeding the sheet placed on the sheet placing tray; a first sheet detection unit for detecting presence of the sheet on the sheet placing tray at a first detection position; a second sheet detection unit for detecting presence of the sheet on the sheet placing tray at a second detection position disposed on an upstream side of the first sheet detection position in a sheet feeding direction; and a control unit which controls the feeding member so as not to perform the sheet feeding operation when the first detection unit is in a state in which the sheet is detected and the second detection unit is in a state in which the sheet is not detected.

According to the present invention, there is provided A sheet feeding apparatus comprising: a sheet placing tray on which a sheet is placed; a feeding member for feeding the sheet placed on the sheet placing tray; a first sheet detection unit for detecting presence of the sheet on the sheet placing tray at a first detection position; a second sheet detection unit for detecting presence of the sheet on the sheet placing tray at a second detection position disposed on an upstream side of the first sheet detection position in a sheet feeding direction; an alarm unit for alarming that the sheet is not correctly placed on the sheet placing tray, and a control unit which controls the feeding member so as not to perform the sheet feeding operation when the first detection unit is in a state in which the sheet is not detected and the second detection unit is in a state in which the sheet is detected, and controls the alarm unit to alarm that the sheet is not correctly placed on the sheet placing tray.

BRIEF DESCRIPTION OF THE DRAWINGS

FIG. 11 is a view showing an operation of a control unit based on a detection result of the document presence sensor.

DESCRIPTION OF THE PREFERRED EMBODIMENTS

Hereafter, a preferable embodiment of the present invention will be described in detail in an exemplifying manner with reference to the appended drawings. However, it should be noted that the dimension, material, or shape of the constituent elements described in this embodiment as well as the relative arrangement thereof are to be suitably modified in accordance with the construction and various conditions of the apparatus to which the invention is applied, and are not to limit the scope of the invention to the following embodiment.

Figure 1:
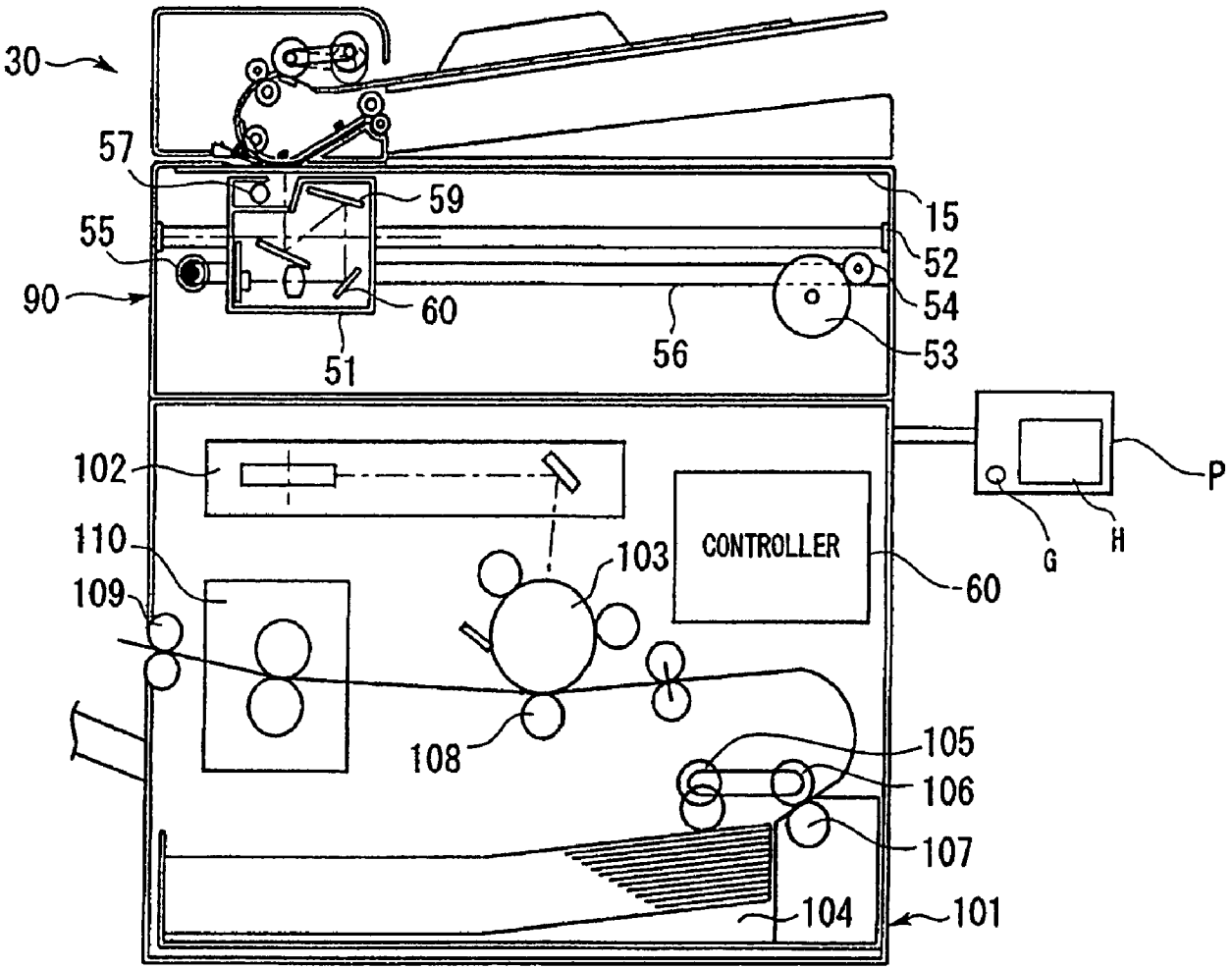
FIG. 1 is a schematic cross-sectional view of an image forming apparatus provided with an automatic document feeding apparatus of this embodiment.

First, an image forming apparatus according to this embodiment will be described with reference to the appended drawings. FIG. 1 is a schematic cross-sectional view of an image forming apparatus 101 provided with an automatic document feeding apparatus 30 serving as a sheet feeding apparatus according to this embodiment.

Referring to FIG. 1, the image forming apparatus 101 has a laser beam scanner 102 for image writing and a photosensitive drum 103. The laser beam scanner 102 performs an image processing on the image that has been read by an image reading apparatus (hereafter referred to as scanner unit) 90, and thereafter radiates a laser beam onto the photosensitive drum 103 in accordance with the recorded signal. A latent image is formed when the laser beam is radiated onto the photosensitive drum 103.

Also, the image forming apparatus 101 has a cassette 104 for storing sheets (recording medium) such as paper or film, a pick-up roller 105 serving as a feeding member for feeding the sheets to the photosensitive drum 103, a conveying roller 106, and a separation roller 107. Here, the sheets stored in the cassette 104 are picked up by the pick-up roller 105 in accordance with the recorded signal, and are supplied one by one to a position opposing to the photosensitive drum 103 by the conveying roller 106 and the separation roller 107.

Further, the image forming apparatus 101 has a transfer apparatus 108 for transferring a toner image, which is formed by the toner supplied from a toner supplying apparatus (not illustrated), to the sheets, a fixing apparatus 110 that fixes the toner image transferred to the sheets, and a discharge roller 109 disposed on the downstream side of the fixing apparatus 110 for discharging the sheets having completed the fixation of the toner image to a discharge tray placed outside of the image forming apparatus 101.

The image forming apparatus 101 includes a control panel P provided with a display unit H that displays predetermined information to a user and a reading start button G that is pressed by the user for starting the reading at the scanner unit 90. The reading start button G functions as an operation unit that is operated by the user for starting the feeding of a document.

Figure 2:
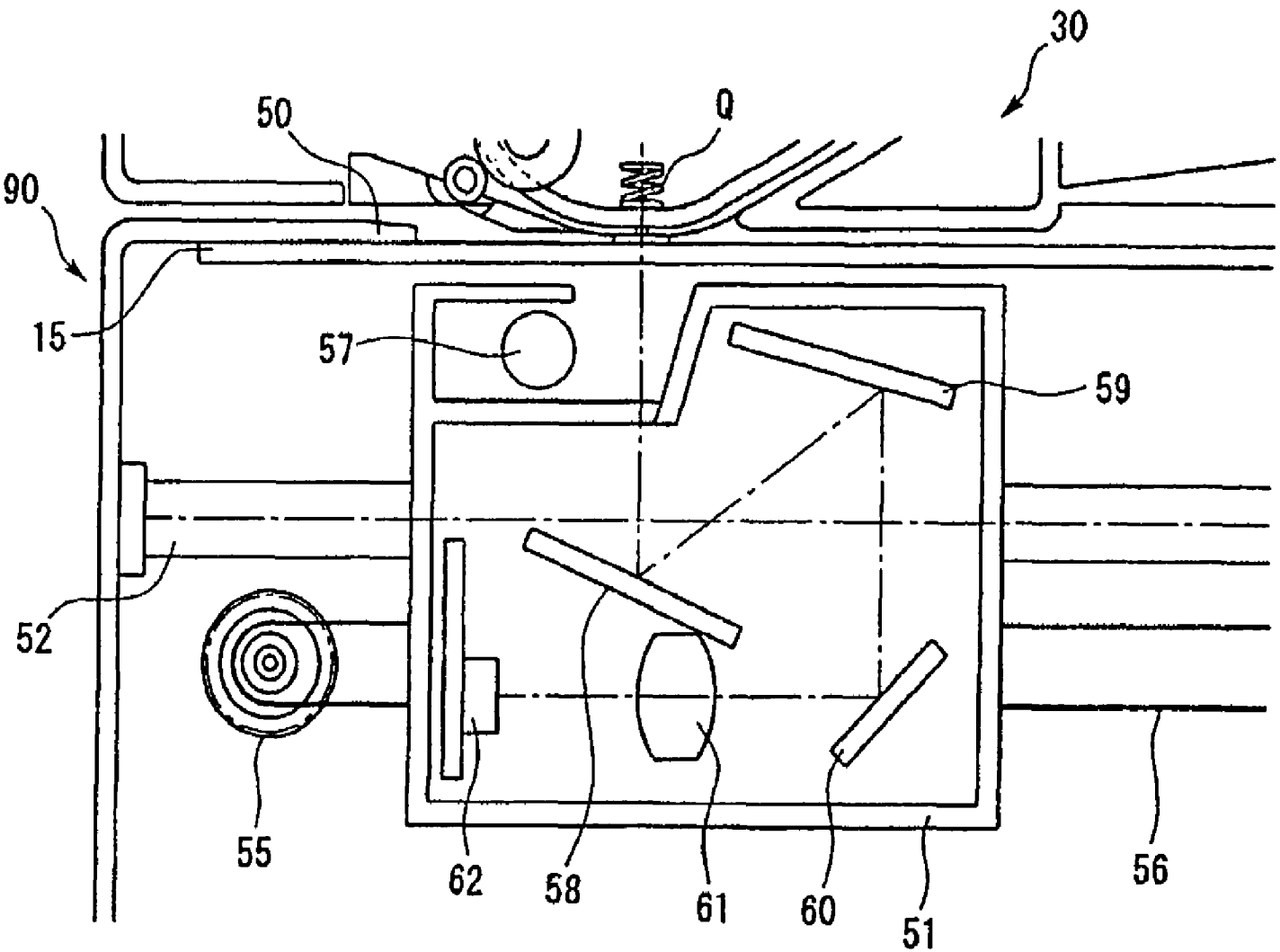
FIG. 2 is a partial cross-sectional view of an image reading apparatus provided with an automatic document feeding apparatus of this embodiment.

Next, with reference to FIGS. 1 and 2, the scanner unit 90 placed above the image forming apparatus 101 will be described. FIG. 2 is a schematic partial cross-sectional view of the scanner unit 90 provided with an automatic document feeding apparatus 1 according to this embodiment. The scanner unit 90 is provided with a document base platen glass 15 on which the user places a document.

In addition, referring to FIG. 1, the scanner unit 90 has an image reading carriage 51 mounted to be movable along a guide shaft 52 in the lateral direction of FIG. 1 for reading the document placed on document base platen glass 15 while moving. Driving force is transmitted from a carriage driving motor via a driving gear 53, driving pulleys 54, 55, and a driving belt 56 to the image reading carriage 51 that serves as reading means.

Referring to FIG. 2, a lamp 57 for irradiating the document, reflection mirrors 58, 59, 60, a lens 61, and a photoelectric conversion element 62 are mounted on the image reading carriage 51. A document image irradiated by this lamp 57 is guided to the photoelectric conversion element 62 by passing through the lens 61 via the reflection mirrors 58, 59, 60.

In reading the document conveyed by the ADF 30 (automatic document feeding apparatus), the reading is carried out in a state in which this image reading carriage 51 remains stationary at a predetermined reading position Q.

Figure 3:
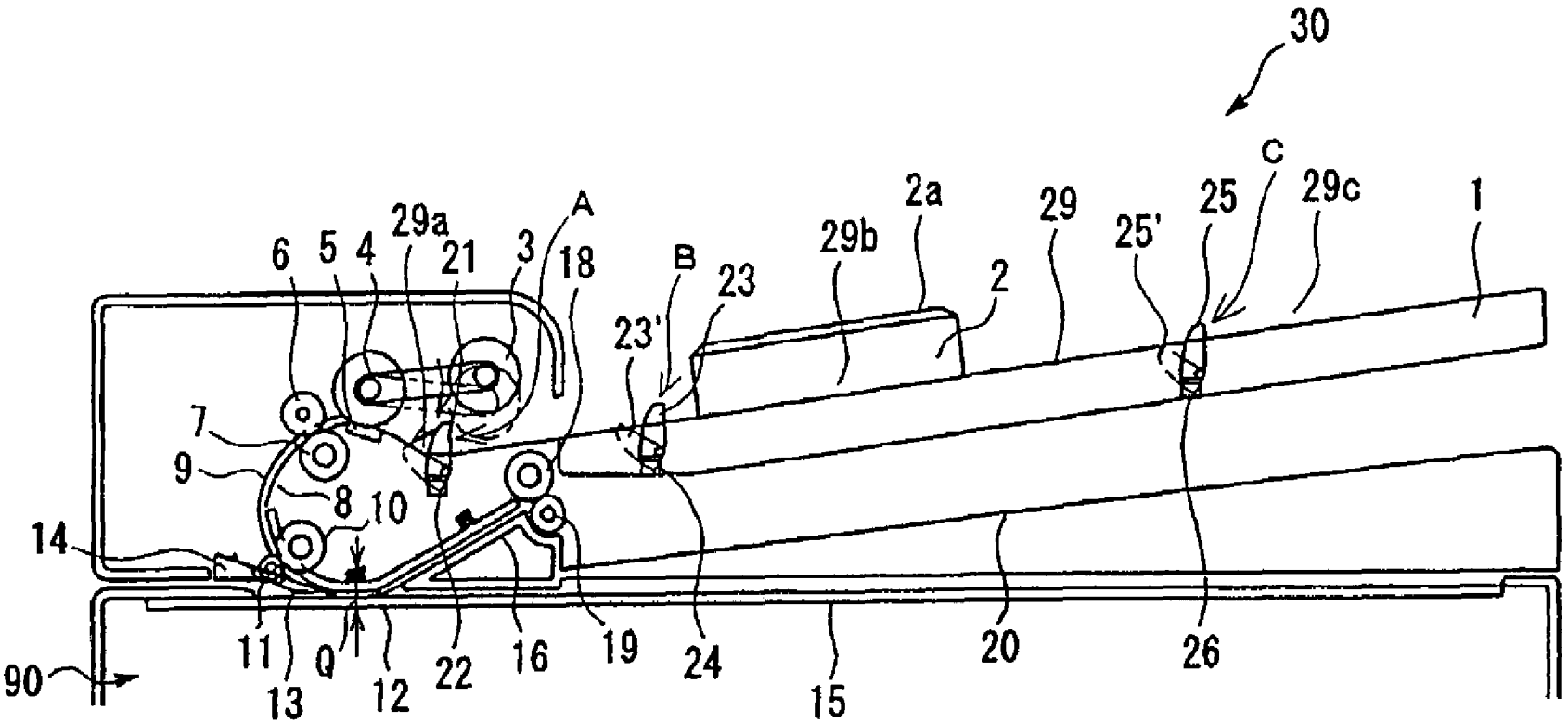
FIG. 3 is a schematic cross-sectional view of an automatic document feeding apparatus of this embodiment.
Figure 4:
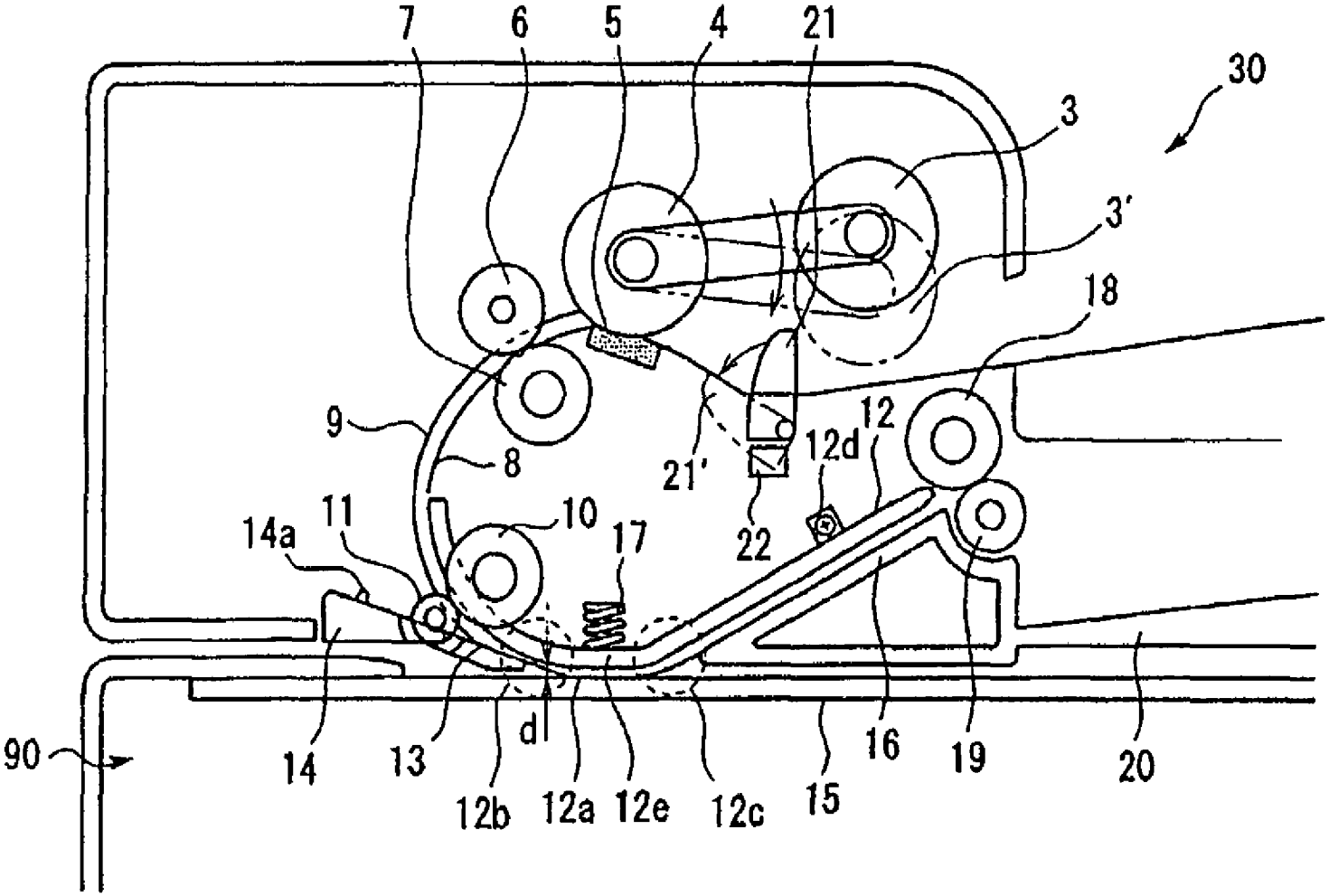
FIG. 4 is an enlarged view of an essential part of FIG. 3.

Referring to FIG. 1, the ADF (automatic document feeding apparatus) placed above the aforementioned scanner unit 90 will be described. FIG. 3 is a schematic cross-sectional view of the ADF 30 according to this embodiment. FIG. 4 is a partially enlarged view of FIG. 3.

Referring to FIG. 3, the ADF 30 has a document tray 1 serving as a sheet placing tray for placing documents (sheets), a width regulating plate 2 for regulating the side of the documents, a pick-up roller 3 that can descend to a position abutting the documents (position 3' on the upper surface of the document) for feeding the documents, and a separation roller 4 that is always in contact with an opposing separation pad 5 to perform friction separation for conveying the documents one by one.

Further, the ADF 30 has a first conveying roller 6 and a conveying roll 7 for conveying the document separated by the separation roller 4, and an inner guide 8 and an outer guide 9 for guiding the document sandwiched by the first conveying roller 6 and the conveying roll 7. Also, the ADF 30 has a before-reading roller 10 and a reading pressure roll 11 that are curved and tilted towards the bottom of the ADF body. The document is conveyed to the reading position Q by passing through these conveying mechanisms.

In addition, a reading guide 12 for guiding the document is disposed on the back side of the document (side opposite to the reading surface) near the reading position Q. On the opposite side of this reading guide 12, a guide mylar 13 serving as a transparent sheet which is a transparent film member is attached as means for guiding the front side of the document. The guide mylar 13 is, for example, a transparent plastic film made, for example, of a PET material, and is constructed to have a thickness of about 100 μm. Here, a member that locks the guide mylar 13 with a boss part is called a mylar holder 14. Namely, referring to FIG. 4, one end of the guide mylar 13 is locked by a boss part 14*a* of the mylar holder 14 and the other end passes through the document base platen glass 15 to be mounted on the discharge guide 16.

Further, referring to FIG. 4, the reading guide 12 is formed with a planar part 12*a* whose surface opposing the reading position Q is parallel to the document base platen glass 15, an upstream side tilt part 12*b* that is curved and tilted towards the upstream side from the planar part 12*a* serving as a base point, and a downstream side tilt part 12*c* that is curved and tilted towards the downstream side.

In addition, the reading guide 12 is attached to be capable of freely swinging around a swing fulcrum 12*d* serving as a center, and is urged towards the document base platen glass 15 by urging means 17.

At both ends of the planar part 12*a* in the direction perpendicular to the conveying direction, a hitting protrusion 12*e* is provided as a protrusion member, whereby a minute interval d to the guide mylar 13 is held to be constant. Therefore, the guide mylar 13 is in contact with the document base platen glass 15 near the reading position Q, and the document image is read through these guide mylar 13 and the document base platen glass 15.

The document that has passed through the reading position Q is conveyed along the guide mylar 13 mounted on the discharge guide 16 that is tilted towards the upper side of the ADF 30 body, and is discharged to the discharge tray 20 by the discharge roller 18 and the discharge pressure roll 19 serving as downstream side conveying means.

As described above, in the ADF 30, the conveying path from the document tray 1 through the reading position Q to the discharge tray 20 is constructed as a U-turn path.

Also, three detection mechanisms are disposed on the document tray 1 of the ADF 30 of this embodiment. One is a document front end detection mechanism A (first sheet detection unit). The document front end detection mechanism A is constituted of a first document presence sensor flag 21 and a first document presence detection sensor 22 shown in FIG. 3. The document front end detection mechanism A detects whether there is a document at a first detection position corresponding to the front end of the document placed on document tray 1.

In the ADF 30, a document detection mechanism B (second sheet detection unit) is disposed on the upstream side of the document front end detection mechanism A of the document tray 1 in the direction of conveying the document. Further, a document rear end detection mechanism C (third sheet detection unit) is disposed on the upstream side of the document detection mechanism B of the document tray 1 in the direction of conveying the document.

The document detection mechanism B is constituted of a second document presence sensor flag 23 and a second document presence sensor 24. The document rear end detection mechanism C is constituted of a third document presence sensor flag 25 and a third document presence detection sensor 26. The document detection mechanism B detects whether there is a document at a second detection position on the front end side of the document placed on the document tray 1 and on the upstream side of the position at which the document placed on the document tray 1 is detected by the document front end detection mechanism A in the conveying direction. The document rear end detection mechanism C detects whether there is a document at a third detection position on the rear end side of the document placed on the document tray 1.

Further, the ADF 30 has a width detection sensor (width detection mechanism) for detecting the width dimension of the placed document from the locking position of the width regulating plate 2, though not illustrated in the drawings. This width detection sensor interlocks with the document detection mechanism B (the second document presence detection flag 23 and the second document presence detection sensor 24) to detect a predetermined sheet having a prescribed size such as A4, A5, B5, or LTR.

The size of the document placed on the document tray 1 in the conveying direction is detected on the basis of the output of the second document detection sensor 24 of the document detection mechanism B and the third document detection sensor of the document rear end detection mechanism C. Namely, when the third document presence detection sensor 26 is brought into a detected state together with the second document presence detection sensor 24, the apparatus determines that the document placed on the document tray 1 is a document having a large size such as A3, B4, LDR, or LGL in which the aforesaid medium is stretched. In contrast, when the third document presence detection sensor 26 is in a non-detected state whereas the second document presence detection sensor 24 is in a detected state, the apparatus determines that a document having a size smaller than the predetermined size has been placed on document tray 1. In this embodiment, the apparatus determines the size of the document in the conveying direction assuming that the first document presence detection sensor 22 is in a detected state.

Here, the detected state of the document presence detection sensor in each of the detection mechanisms A, B, C refers to the state in which each document presence detection sensor has detected the presence of a document at a position where each document presence detection sensor is placed, whereas the non-detected state of the document presence detection sensor in each of the detection mechanisms A, B, C refers to the state in which each document presence detection sensor has detected the absence of a document at a position where each document presence detection sensor is placed.

Figure 5:
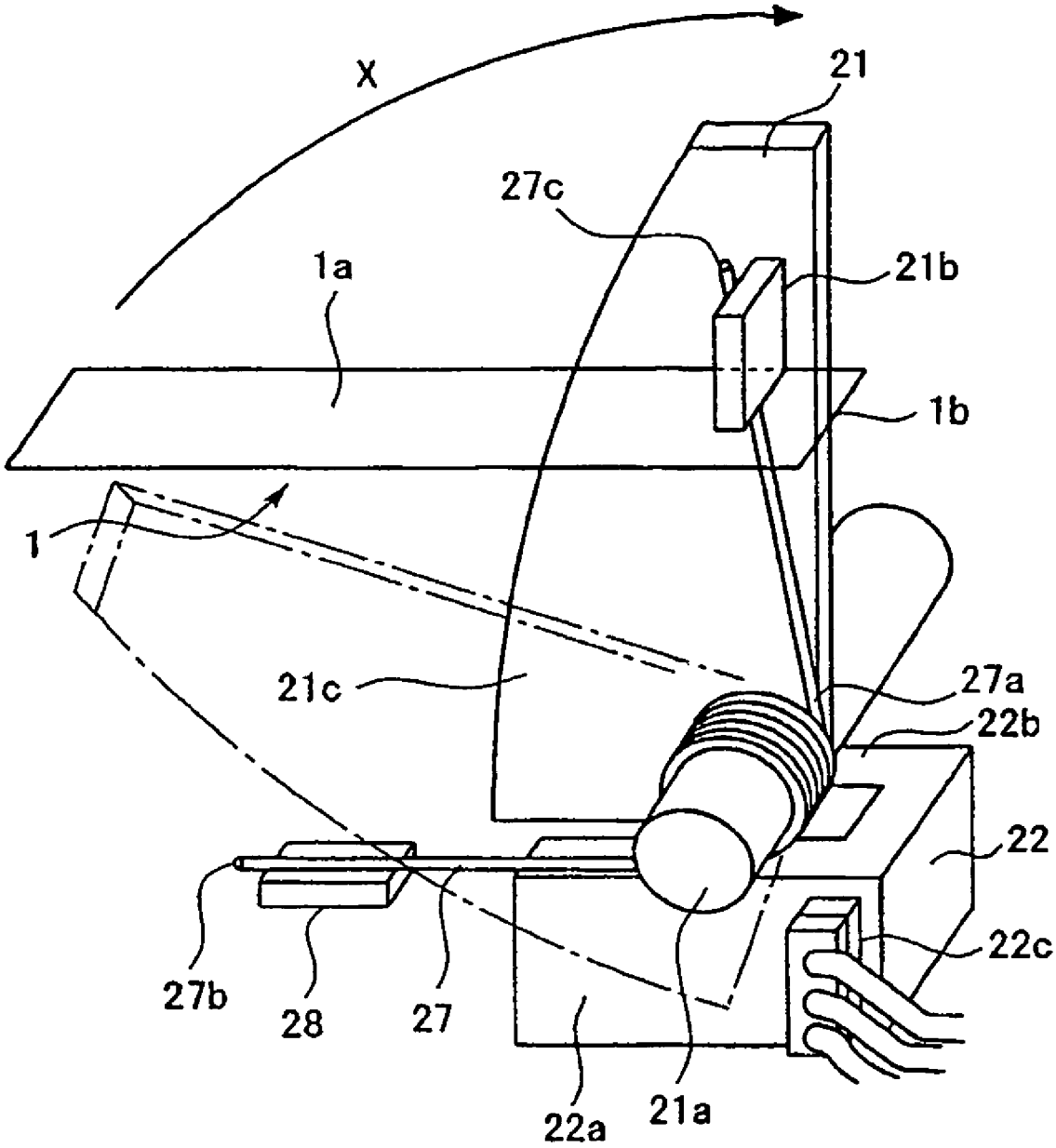
FIG. 5 is a schematic view showing a detection-OFF (light-transmitted) state in this embodiment.
Figure 6:
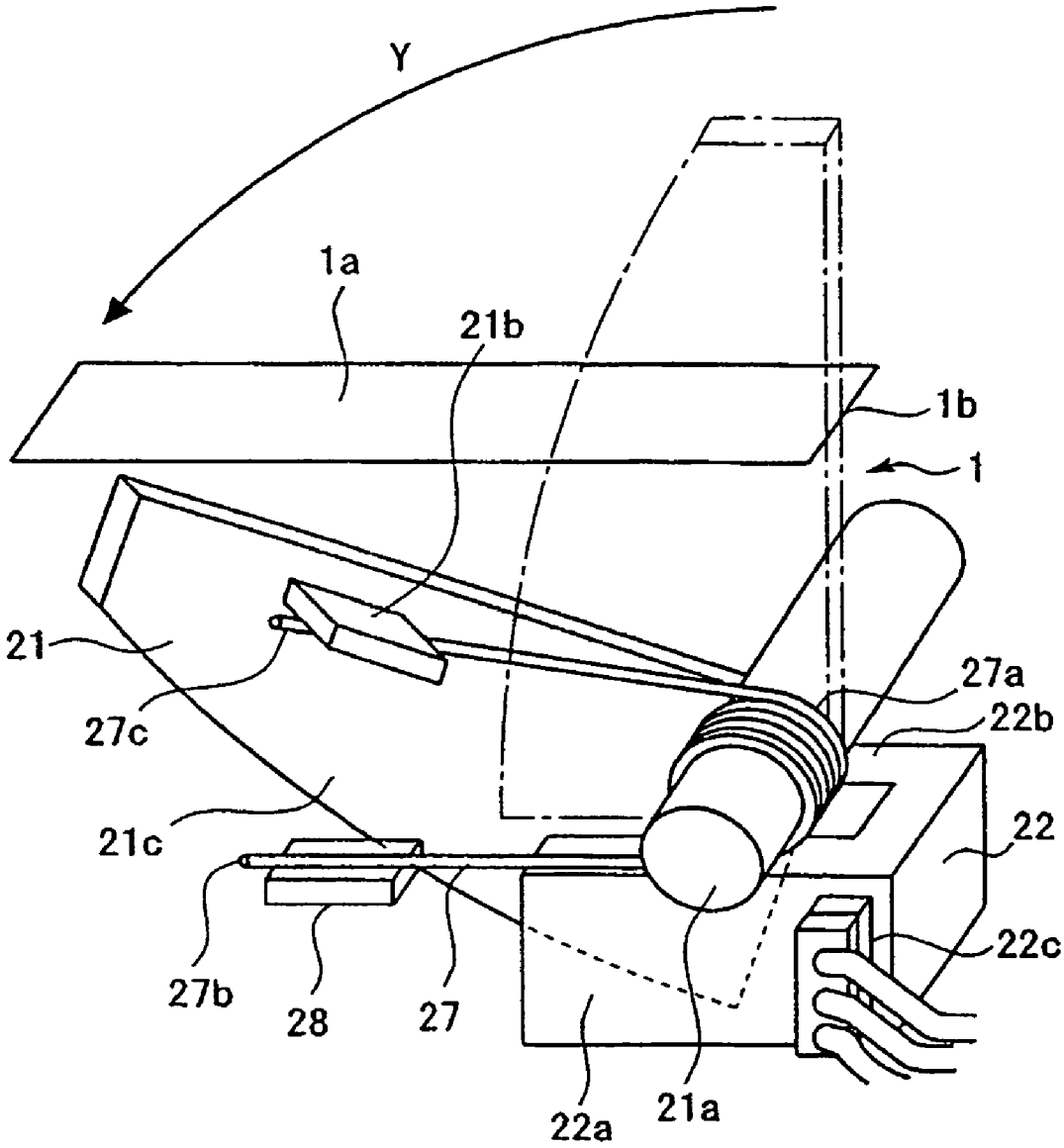
FIG. 6 is a schematic view showing a detection-ON (light-shielded) state in this embodiment.

The construction of the first document presence sensor flag 21 and the first document presence detection sensor 22 (refer to FIG. 4) will be described in detail with reference to FIGS. 5 and 6. FIG. 5 is a schematic view showing a detection-OFF (light-transmitted) state, and FIG. 6 is a schematic view showing a detection-ON (light-shielded) state. Here, the second document detection flag 23 and the second document presence detection sensor 24 as well as the third document detection flag 25 and the third document presence detection sensor 26 have the same construction as the first document presence sensor flag 21 and the first document presence detection sensor 22, so that the description thereof will not be repeated here.

The first document presence sensor flag 21 is supported at both ends by a swing support shaft 21*a* to be capable of swinging. The first document presence sensor flag 21 is urged by a sensor flag urging spring 27 which is a torsion coil spring.

The sensor urging spring 27 includes a coil part 27*a*. One end 27*b* of the spring leg of this coil part 27*a* is received by a stopper 28, and the other end 27*c* is hooked to a hooker part 21*b*, thereby urging the sensor flag 21 in a clockwise direction (in the X direction shown by an arrow in FIG. 5).

A slit 1*a* is formed in the document tray 1 shown in FIG. 1 so as to ensure a movement area of the first document presence sensor flag 21 shown in FIGS. 5 and 6. One end 1*b* of the slit 1*a* acts to stop the rotation of the sensor flag 21. When a document is placed on the document tray 1, the first document presence sensor flag 21 swings in an anti-clockwise direction (in the Y direction shown by an arrow in FIG. 6) against the resistance force of the sensor flag urging spring 27 by the load of the document itself as shown in FIG. 6. When the first document presence sensor flag 21 swings in an anti-clockwise direction, a light-shielding part 21*c* formed in a fan shape is guided to the first document presence detection sensor 22 which is a sensor of transmittance type.

The first document presence detection sensor 22 is receiving, on the light-receiving side 22*b*, the LED light that is emitted from the light-emitting side 22*a*. When the light is received, the sensor 22 detects the absence of the document on the document tray 1, whereas when the light is shielded, the sensor 22 detects the presence of the document on the document tray 1. The detection signal is transmitted through a connector 22*c* to a controller (control means) 60 (refer to FIG. 1) that controls the operation of the ADF 30, the controller 60 being disposed in the image forming apparatus 101. Here, this embodiment is described assuming that the controller 60 is disposed in the image forming apparatus 101; however, the controller 60 may be disposed either in the scanner unit 90 or in the ADF 30. Here, in this embodiment, a construction has been exemplified in which the first document presence detection sensor 22 detects the absence of the document when light is received, and detects the presence of the document when light is shielded; however, a construction may be employed in which the sensor detects the presence of the document when light is received, and detects the absence of the document when light is shielded.

Figure 10:
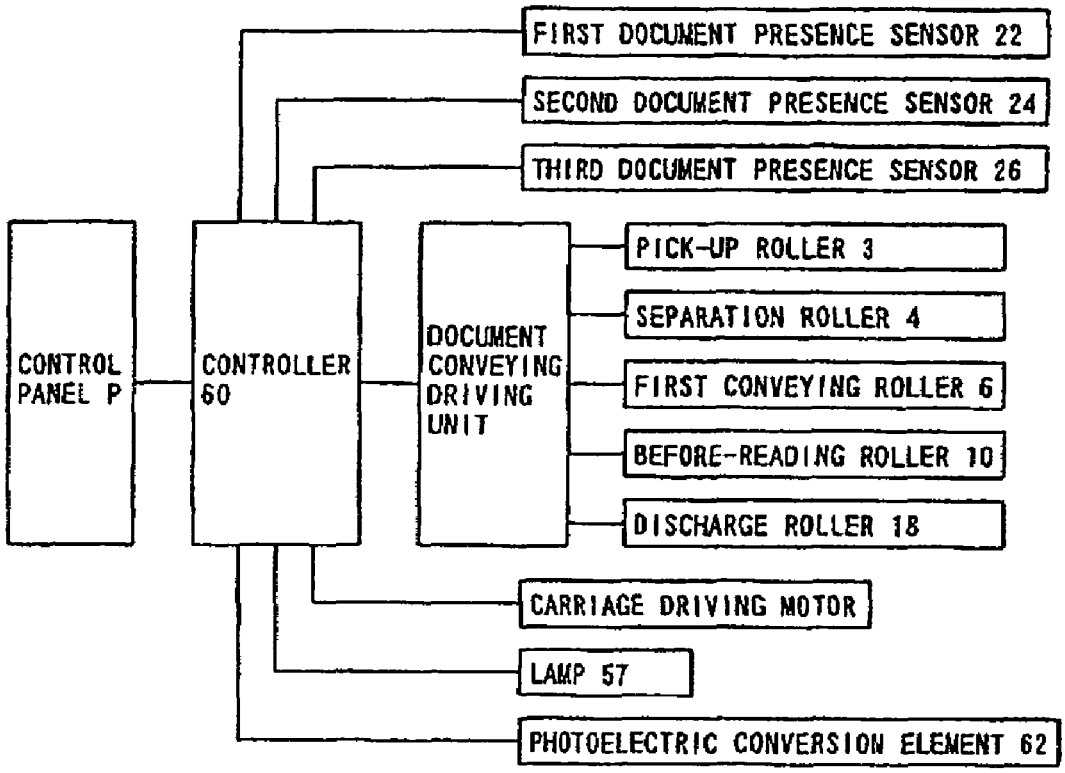
FIG. 10 is a block diagram of a control system in an image reading apparatus of this embodiment.

FIG. 10 is a block diagram of a control system of the scanner unit 90. The controller 60 controls the driving and stopping of the pick-up roller 3, the separation roller 4, the first conveying roller 6, the before-reading roller 10, and the discharge roller 18 via a document conveying driving unit of the ADF 30. Also, the controller 60 controls a reading unit which is constituted of the image reading carriage 51, the carriage driving motor, the lamp 57, the photoelectric conversion element 62, and others to control the movement of the image reading carriage 51, the deenergization of lamp 57, and the reading operation performed by the photoelectric conversion element 62. Further, an input signal that is input by a user through the control panel P is input into the controller 60, and the controller 60 performs a predetermined display on the display unit H of the control panel P.

Detection results obtained by the first document presence detection sensor 22, the second document presence detection sensor 24, and the third document presence detection sensor 26 are input into the controller 60. The controller 60 performs various controls on the basis of the detection results obtained by the first document presence detection sensor 22, the second document presence detection sensor 24, and the third document presence detection sensor 26.

FIG. 11 is a view showing the operations performed by the controller 60 on the basis of the detection results obtained by the first document presence detection sensor 22, the second document presence detection sensor 24, and the third document presence detection sensor 26 when the reading start button G is pressed.

When all of the first document presence detection sensor 22, the second document presence detection sensor 24, and the third document presence detection sensor 26 are in a detected state (when in code (1)), the apparatus recognizes that the length of the document placed on the document tray 1 in the conveying direction is a large size, and the controller 60 controls the document conveying driving unit of the ADF 30 so as to start the feeding operation of the document. Further, the controller 60 controls the reading unit so as to read the images on the document conveyed by the ADF 30.

When the first document presence detection sensor 22 and the second document presence detection sensor 24 are in a detected state and the third document presence detection sensor 26 is in a non-detected state (when in code (2)), the apparatus recognizes that the length of the document placed on the document tray 1 in the conveying direction by pressing the reading start button G is a small size, and the controller 60 controls the document conveying driving unit of the ADF 30 so as to start the feeding operation of the document. Further, the controller 60 controls the reading unit so as to read the images on the document conveyed by the ADF 30.

The above-described cases of code (1) and code (2) are cases in which the document is correctly set, and the details thereof will be described later.

When the first document presence detection sensor 22 is in a detected state and the second document presence detection sensor 24 is in a non-detected state (when in code (3)), the apparatus prohibits the feeding of the document and does not perform the feeding of the document even if the reading start button G is pressed. In this case, the apparatus further alarms that the document should be correctly set with the display unit H of control panel P.

When the first document presence detection sensor 22 is in a non-detected state and the second document presence detection sensor 24 and the third document presence detection sensor 26 are in a detected state (when in code (4)), the apparatus prohibits the feeding of the document and does not perform the feeding of the document even if the reading start button G is pressed. In this case, the apparatus further alarms that the document should be correctly set with the display unit H of control panel P. Also, when the first document presence detection sensor 22 and the third document presence detection sensor 26 are in a non-detected state and the second document presence detection sensor 24 is in a detected state (when in code (5)) or when the first document presence detection sensor 22 and the second document presence detection sensor 24 are in a non-detected state and the third detection sensor 26 is in a detected state (when in code (6)), the controller 60 performs a control similar to that of code (4).

Here, the above-described cases of code (3) to code (6) are state in which the document is not correctly set, and the details thereof will be described later.

When all of the first document presence detection sensor 22, the second document presence detection sensor 24, and the third detection sensor 26 are in a non-detected state (when in code (7)), the controller 60 controls the reading unit to read the document while the moving image reading carriage 51 so as to read the document placed on the document base platen glass (book reading mode).

Figure 7:
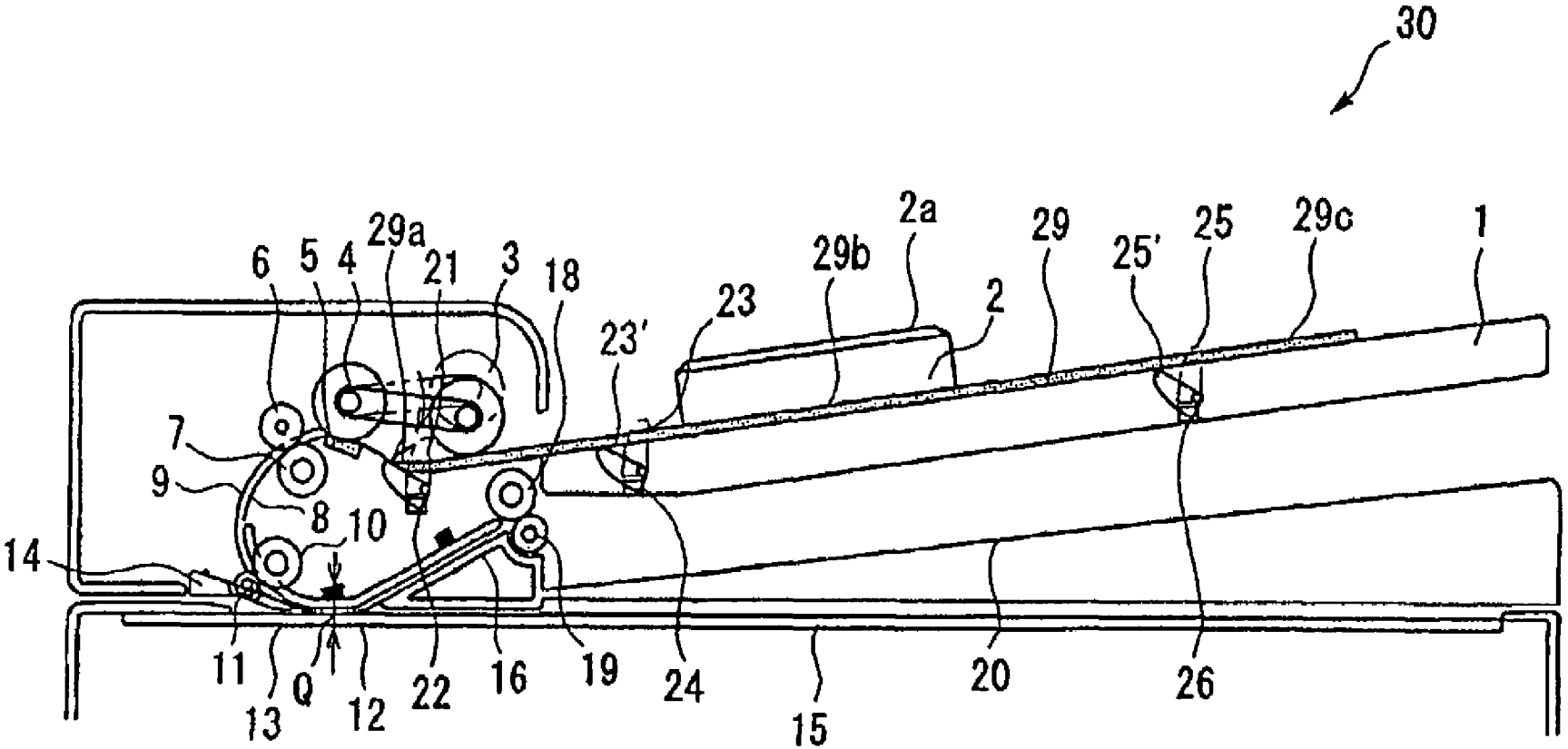
FIG. 7 is a view showing a state in which a document is correctly placed on a document tray in this embodiment.

Next, the process of conveying the document when the user has placed the document at a correct position will be described. FIG. 7 is a schematic cross-sectional view showing the state in which the document has been correctly placed on the document tray 1. Referring to FIG. 7, when a document is placed on the document tray 1, the front end 29*a* of the document makes the document presence sensor flag 21 swing downwards, whereby the first document presence sensor 22 detects the presence of the document.

Also, a middle part 29*b* of the document or, depending on the document size, the rear end 29*c* of the document makes the second document presence flag 23 and the third document presence flag 25 swing downwards in a similar manner. Here, when the size of the document is detected, the document is conveyed to the reading position Q of the image reading apparatus by the user's pressing of the reading start button G.

Next, the process of conveying the document when the user has placed the document at a wrong position will be described.

<First Aspect>

Figure 8:
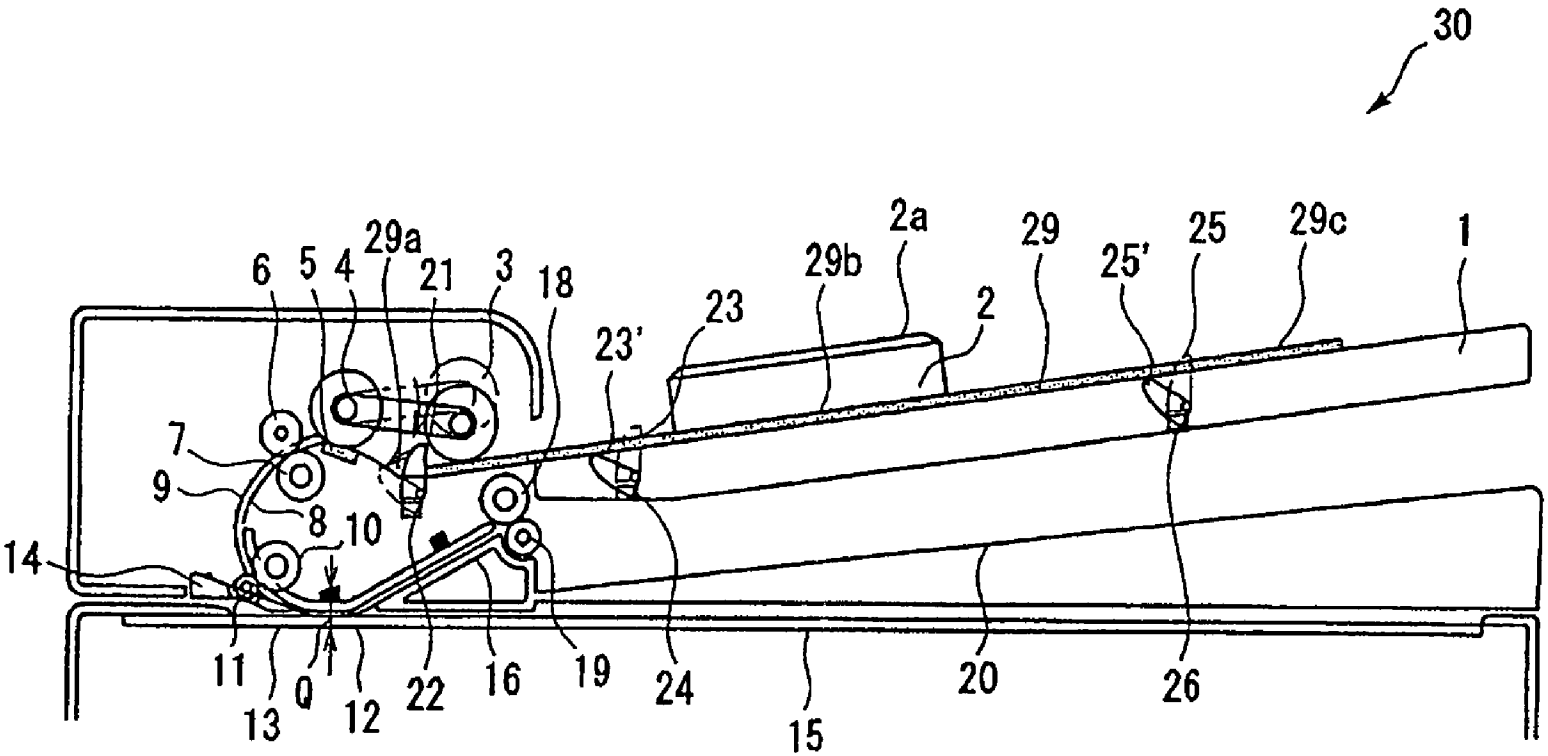
FIG. 8 is a view showing a state (first aspect) in which a document is placed at a wrong position of the document tray in this embodiment.

FIG. 8 is a schematic cross-sectional view showing an example of an aspect in which the user has made a mistake in placing the document. Referring to FIG. 8, the document placed by the user is placed by being shifted towards the upstream side of the document tray 1 relative to the predetermined placing position in the conveying direction. In this case, the front end 29*a* of the document has not reached the first document presence sensor 21, so that the ADF 30 cannot detect the placement of the document on the document tray 1.

The controller 60 of the ADF 30 in this embodiment recognizes that the document is not correctly placed on the document tray 1 when the controller 60 receives a signal stating absence of the document from the first document presence sensor 22 (states of code (4) to code (6) in FIG. 11) in a state in which at least one of the second document presence detection sensor 24 and the third document presence detection sensor 26 is in a document-detected state. When the user presses the reading start button G in this state, the controller 60 of the ADF 30 alarms the user by displaying a message stating that the document is not correctly placed on the display unit H of operation panel P serving as alarming means. When a placement mistake such as this case occurs, an announcement to prompt the user to shift the document towards the pick-up roller 3 (in the conveying direction of the document) may be made as an announcement stating that the document is not correctly placed.

<Second Aspect>

Figure 9:
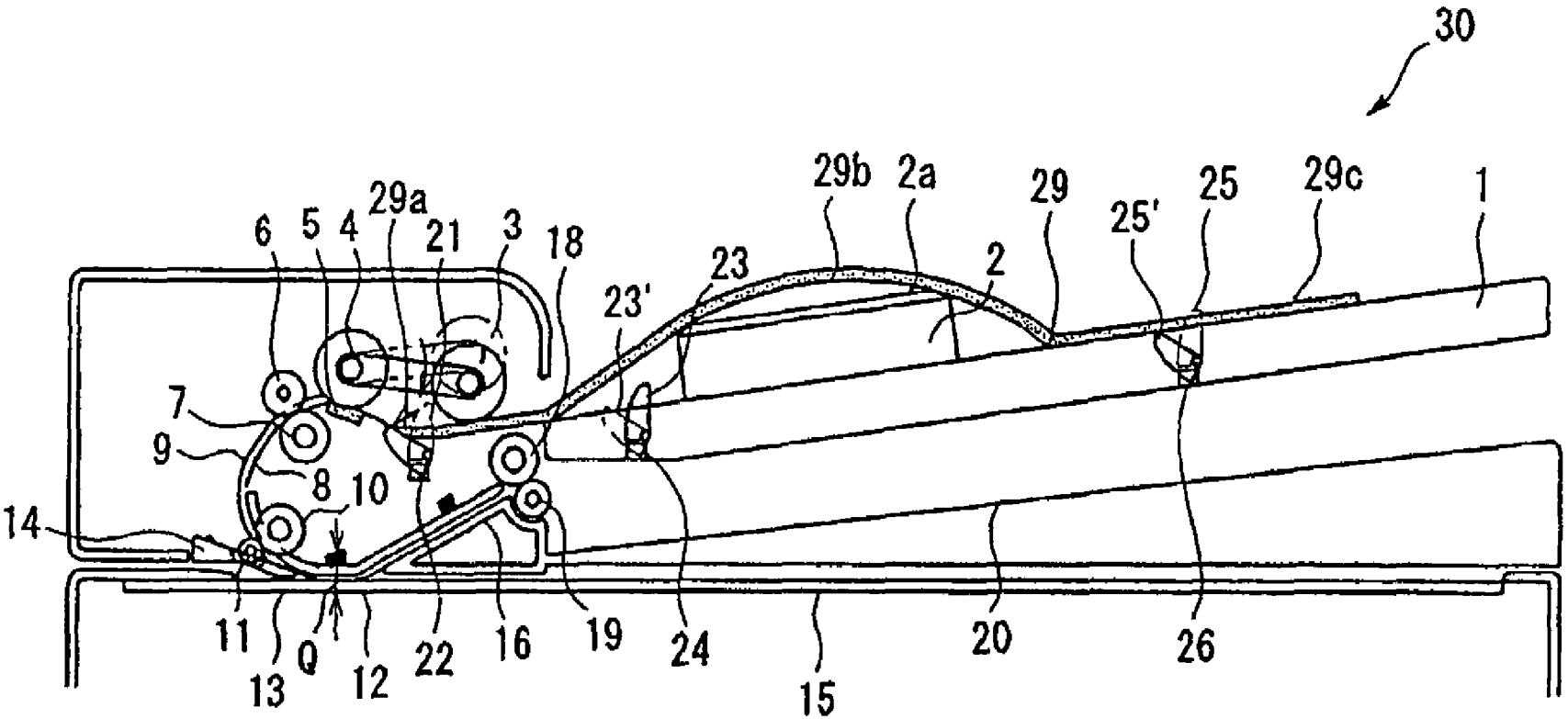
FIG. 9 is a view showing a state (second aspect) in which a document is placed at a wrong position of the document tray in this embodiment.

FIG. 9 is a schematic cross-sectional view showing the second example in which the user has made a mistake in placing the document. Referring to FIG. 9, the width regulating plate 2 is provided with a load regulating part 2*a* that determines the upper limit of the amount of the load on the document tray 1. By being in contact with the upper surface of the documents placed on the document tray 1, load regulating part 2*a* prevents the user from placing a document bundle having a total thickness exceeding the product specification on the document tray 1.

When the user hooks the document on the load regulating part 2*a* in placing the document by accident, the document may override the load regulating part 2*a*. Since the front end 29*a* of the document is pressed in to the predetermined position, the first document presence sensor 22 detects the presence of the document, and the rear end 29*c* of the document is detected by the third document presence detection sensor 26.

However, when the middle part 29*b* of the document overrides the load regulating part 2*a*, the second document presence detection sensor 24 is in a non-detected state (state of code (3) in FIG. 10). Here, in the case of a small-size document, the rear end 29*c* of the document does not reach the third document presence detection sensor 26, so that both the second document presence detection sensor 24 and the third document presence detection sensor 26 are in a non-detected state.

When the first document presence detection sensor 22 is in a detected state and the second document presence sensor 24 is in a non-detected state in this manner, the controller 60 recognizes that the document is not correctly placed on the document tray 1.

For this reason, when the user presses the reading start button G in this state, the controller 60 prohibits the feeding of the document by the ADF 30 so as not to feed the document, and performs control to display a message stating that the document is not correctly placed on the display unit H of the operation panel P. In the case of a placement mistake having such a form, the message stating that the document is not correctly placed may be a display to inform that the document overrides the width regulating plate 2.

Figure 12:
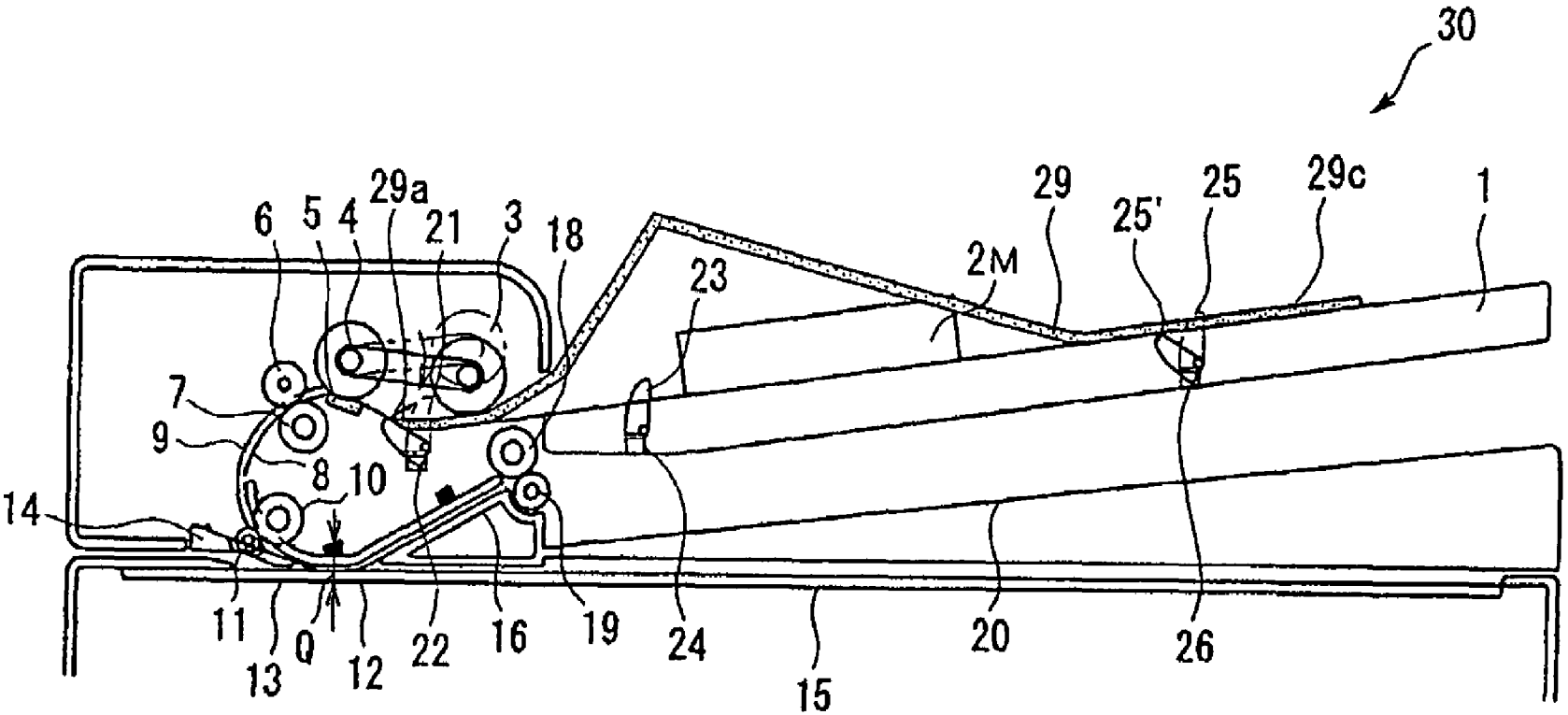
FIG. 12 is a view showing a state in which a document is erroneously placed on the document tray.

Also, the user may place a document that is largely curled or a document having a crease. There is a fear that, after the document is fed, the document cannot be conveyed due to the curl or crease of the document, thereby causing a jam. FIG. 12 shows a state in which a document having a crease is erroneously placed. Even when such a document that is largely curled or a document having a crease that may possibly cause poor feeding is placed, the first document presence detection sensor 22 is in a detected state and the second document presence sensor 24 is in a non-detected state. As described above, when the user presses the reading start button B in this state, the controller 60 performs control to display a message stating that the document is not correctly placed on the display unit H of operation panel P.

Here, the message stating that the document is not correctly placed when the first document presence detection sensor 22 is in a detected state and the second document presence detection sensor 24 is in a non-detected state may be, for example, a message prompting the user to remove the crease and place the document again. Here, the width regulating plate 2M in the embodiment shown in FIG. 12 has a construction without having a load regulating part that is brought into contact with the upper surface of the documents.

As described above, according to the ADF 30 of this embodiment, reading in the book mode that is not intended by the user can be avoided. This prevents the user from considering that the machine is out of order without noticing the user's own operation mistake, and the user can find what action to be taken next, thereby improving the operability.

Here, in the above-described embodiment, the display unit H of the operation panel P has been given as an example of the alarming means, and an example has been shown in which the display unit H displays a message stating a document placement mistake or the like. However, the message may be displayed on a display of a personal computer (PC) that is connected to the ADF 30, or may be announced with the use of voice or sound.

When the user has made a placement mistake in placing a document on the ADF, not only a control to display an error of "document absence" simply on the display unit H of the operation panel or the PC but also a control to output a voice announcement of "document placement error" in addition to the display of "document absence", a control to announce a way to place the document at a normal position or in a normal state, or the like control is carried out. By such an embodiment, the user can recognize the correct position of placing the document and the correct way of placing the document at the spot, thereby improving the operability for the user.

According to the construction of this embodiment, an automatic document feeding apparatus can be provided that can feed documents smoothly with improved operability.

Here, in the above-described embodiment, an automatic document feeding apparatus for feeding documents has been given as an example of a sheet feeding apparatus. However, the present invention is not limited to this, and it may be, for example, a sheet feeding apparatus for feeding a recording paper in a sheet form to an image forming unit. Namely, in a sheet processing apparatus having a sheet processing unit that performs a process of forming an image on a sheet or a process of reading an image on a sheet, the sheet feeding apparatus of the present invention can be applied as an apparatus for feeding the sheet to the sheet processing unit that performs a predetermined process on the sheet.

This application claims priority from Japanese Patent Application No. 2004-54301 filed Feb. 27, 2004, which hereby incorporated by reference herein.

What is claimed is:

1. A sheet feeding apparatus comprising:

a sheet placing tray on which a sheet is placed;

a feeding member for feeding the sheet placed on the sheet placing tray;

a first sheet detection unit configured to detect whether the sheet is present at a first predetermined detection position on the sheet placing tray;

a second sheet detection unit configured to detect whether the sheet is present at a second predetermined detection position on the sheet placing tray, wherein the second predetermined detection position is disposed on an upstream side of the first predetermined detection position in a sheet feeding direction of the feeding member; and a control unit which controls the feeding member so as not to perform the sheet feeding operation when the first detection unit detects that the sheet is present at the first predetermined detection position and the second detection unit detects that the sheet is not present at the second predetermined detection position, wherein the first sheet detection unit has a first flag that is disposed on the first predetermined detection position and is caused to swing by abutment of the sheet placed on the sheet placing tray and a first sensor that detects a swing of the first flag, and wherein the second sheet detection unit has a second flag that is disposed on the second predetermined detection position and is caused to swing by abutment of the sheet placed on the sheet placing tray and a second sensor that detects a swing of the second flag.

2. A sheet feeding apparatus of claim 1, further comprising an alarm unit configured to alarm that the sheet is not correctly placed on the sheet placing tray when the first detection unit detects that the sheet is present at the first predetermined detection position and the second detection unit detects that the sheet is not present at the second predetermined detection position.

3. A sheet feeding apparatus of claim 1, further comprising a third sheet detection unit configured to detect whether the sheet is present at a third predetermined detection position on the sheet placing tray, wherein the third predetermined detection position is disposed on an upstream side of the second predetermined detection position in the sheet feeding direction, wherein the control unit determines a size of the sheet placed on the sheet placing tray with respect to the sheet feeding direction on a basis of a detection result obtained by the second sheet detection unit and the third sheet detection unit when the first sheet detection unit detects that the sheet is present at the first predetermined detection position.

4. A sheet feeding apparatus of claim 1, further comprising a third sheet detection unit configured to detect whether the sheet is present at a third predetermined detection position on the sheet placing tray, wherein the third predetermined detection position is disposed on an upstream side of the second predetermined detection position in the sheet feeding direction wherein the control unit controls the feeding member so as not to perform the sheet feeding operation when the first sheet detection unit detects that the sheet is present at the first predetermined detection position and the third sheet detection unit detects that the sheet is present at the third predetermined detection position and the second sheet detection unit detects that the sheet is not present at the second predetermined detection position.

5. A sheet feeding apparatus of claim 4, further comprising an alarm unit configured to alarm that the sheet is not correctly placed when the third sheet detection unit detects that the sheet is present at the third predetermined detection position and the second sheet detection unit detects that the sheet is not present at the second predetermined detection position.

6. A sheet feeding apparatus of claim 1, wherein the first predetermined detection position is close to the feeding member.

7. A sheet feeding apparatus of claim 1, further comprising an operation unit that is operated by an operator, wherein the control unit controls the feeding member to start a feeding operation when the operation unit is operated for starting the sheet feeding operation, and the control unit controls the feeding member so as not to perform the sheet feeding operation when the first sheet detection unit detects that the sheet is present at the first predetermined detection position and the second sheet detection unit detects that the sheet is not present at the second predetermined detection position, even if the operation unit is operated to start the sheet feeding operation.

8. A sheet feeding apparatus of claim 1, wherein the second flag of the second detection unit is biased so that it partially projects from the surface of the sheet placing tray on which a sheet is to be placed.

9. A sheet feeding apparatus of claim 1, further comprising a regulating portion for regulating an amount of sheets placed on the sheet placing tray by contacting the upper surface of the sheet, wherein the second detection position is disposed on a position according to the regulating portion.

* * * * *